US005481814A

United States Patent [19]

Spencer

[11] Patent Number: 5,481,814

[45] Date of Patent: Jan. 9, 1996

[54] SNAP-ON HINGED SHOE

[76] Inventor: Robert A. Spencer, 16 E. Constance Ave., Santa Barbara, Calif. 93105

[21] Appl. No.: 310,499

[22] Filed: Sep. 22, 1994

[51] Int. Cl.[6] ..... A43B 11/00

[52] U.S. Cl. ..... 36/138; 36/103; 36/105; 36/31; 36/50.1; 36/58.6

[58] Field of Search ..... 36/97, 103, 105, 36/138, 31, 33, 50.1, 50.5–58.5, 58.6

[56] References Cited

U.S. PATENT DOCUMENTS

| | | | |
|---|---|---|---|
| 526,626 | 9/1894 | Kregel . | |
| 1,081,678 | 12/1913 | Langerak | 36/138 |
| 1,216,579 | 2/1917 | Lemieux . | |
| 1,964,406 | 6/1934 | Pellkofer | 36/33 X |
| 2,252,315 | 8/1941 | Doree . | |
| 2,304,957 | 12/1942 | Roth | 36/33 |
| 2,342,188 | 2/1944 | Ghez et al. | 36/33 |
| 2,452,649 | 11/1948 | Graves | 36/138 |
| 2,734,284 | 2/1956 | Seurbom . | |
| 2,815,588 | 12/1957 | Ruane | 36/138 |
| 3,192,651 | 7/1965 | Smith . | |
| 3,389,481 | 6/1968 | England . | |
| 3,997,985 | 12/1976 | Shiina | 36/97 |
| 4,120,103 | 10/1978 | Colby | 36/97 |
| 4,136,468 | 1/1979 | Munschy | 36/97 |
| 4,178,925 | 12/1979 | Hirt | 128/36 |
| 4,309,832 | 1/1982 | Hunt | 36/31 X |
| 4,476,638 | 10/1984 | Quacquarini et al. | 36/31 X |
| 4,587,747 | 5/1986 | Courvoisier | 36/117 |
| 4,944,099 | 7/1990 | Davis | 36/97 |
| 4,969,277 | 11/1990 | Williams | 36/97 |
| 5,127,170 | 7/1992 | Messina | 36/105 |
| 5,152,084 | 10/1992 | Bonnaventure | 36/117 |
| 5,184,410 | 2/1993 | Hamilton | 36/105 |
| 5,282,327 | 2/1994 | Ogle | 36/138 |

FOREIGN PATENT DOCUMENTS

| | | | |
|---|---|---|---|
| 92003943 | 3/1992 | WIPO | 36/105 |

*Primary Examiner*—Paul T. Sewell
*Assistant Examiner*—Marie Denise Patterson
*Attorney, Agent, or Firm*—Kenneth J. Hovet

[57] ABSTRACT

A shoe upper is divided into front and back parts which are hinged together at the shoe sole. The hinge may comprise a creased part of the sole or a mechanical hinge. The parts are held in either an open position or a closed position by a tension spring or a rigid element. The spring and element are pivotally secured to the shoe sole so that their longitudinal axis will be above and extend across the rotational axis of the hinge when the shoe is flat. Additionally, the distance between their points of connection will be less than the corresponding length of sole between said points. This will provide a low stress open position and a higher stress closed position. The stress is created by tension in the spring or by the inherent resilience of the shoe sole counteracting the compression force caused by drawing together the points of connection when a user steps into the shoe.

18 Claims, 3 Drawing Sheets

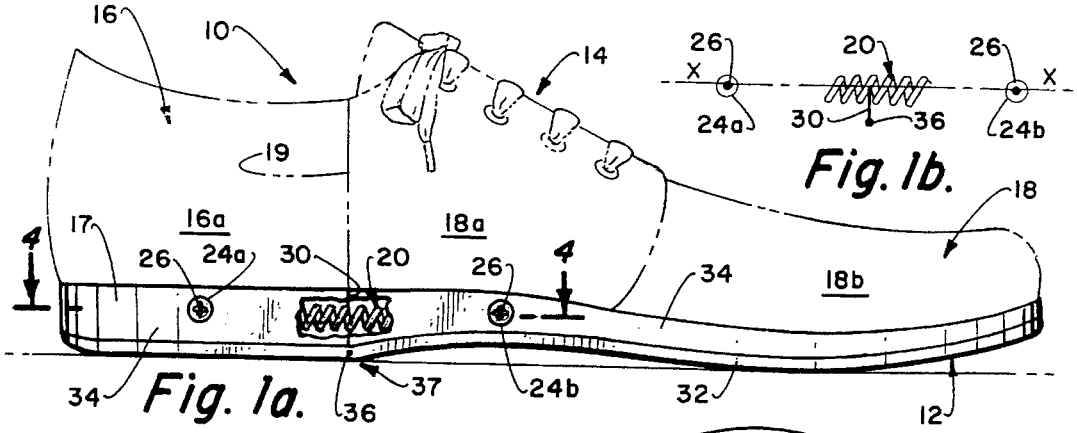
Fig. 1a.
Fig. 1b.
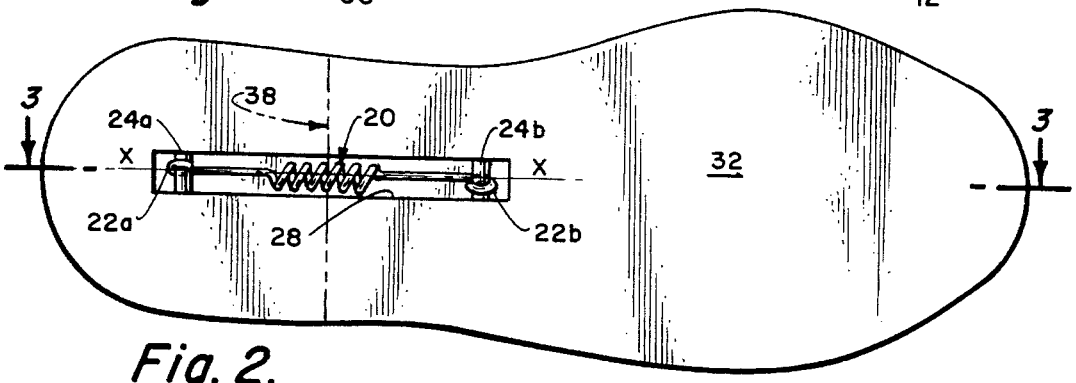
Fig. 2.
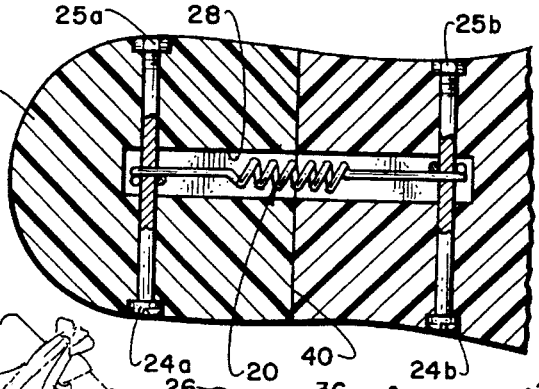
Fig.4.
Fig. 3a.
Fig. 3b
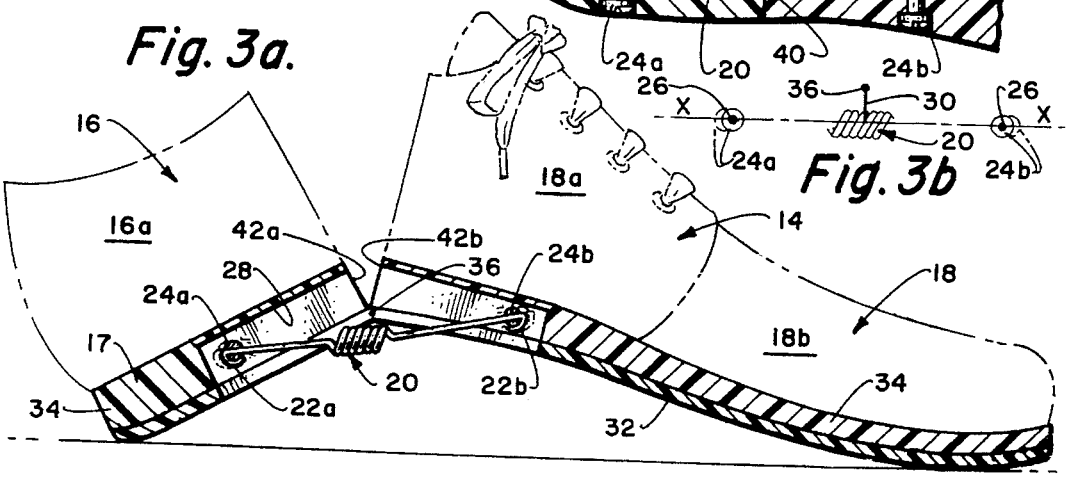

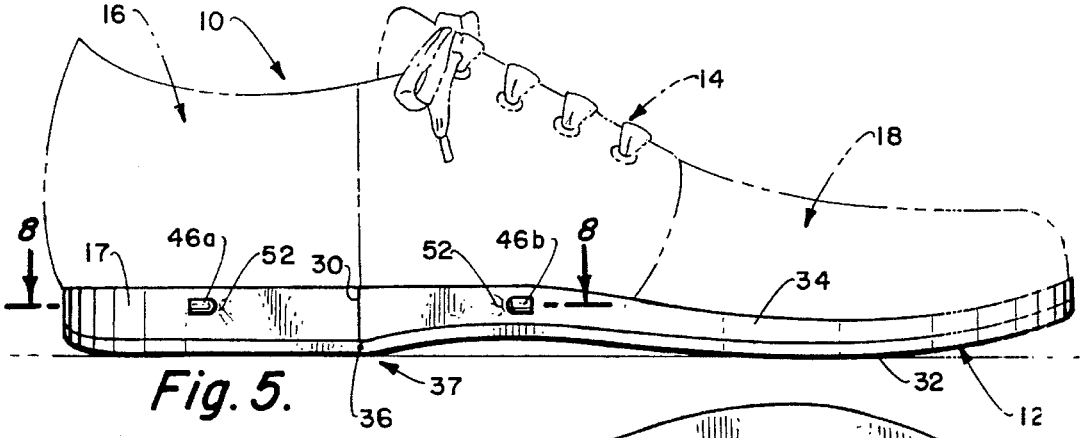
Fig. 5.
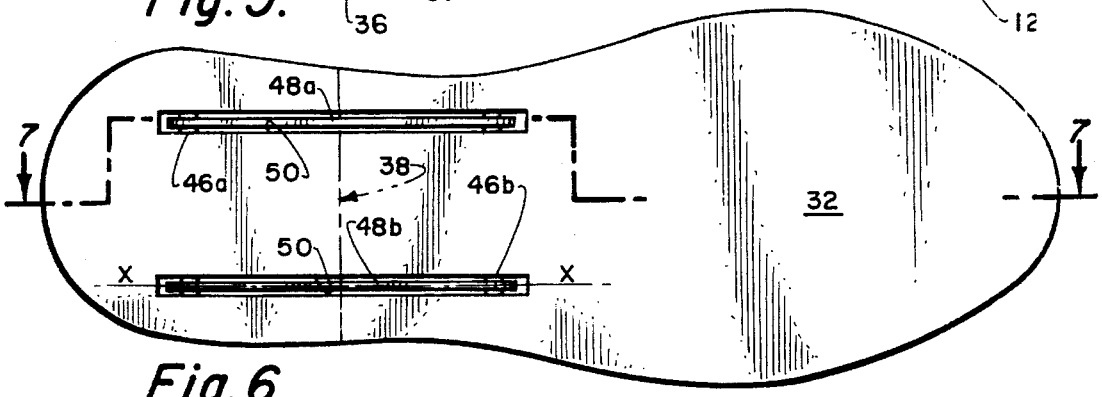
Fig. 6.
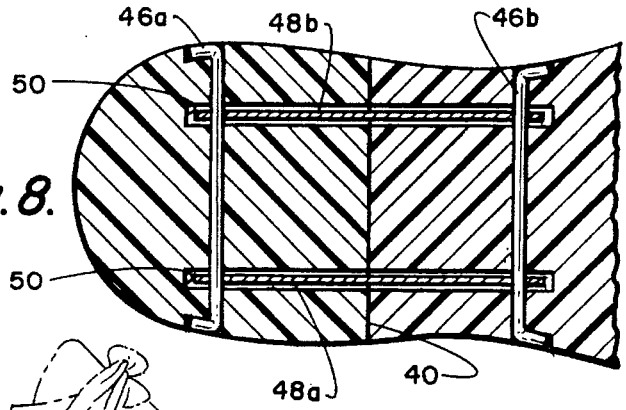
Fig. 8.
Fig. 7.
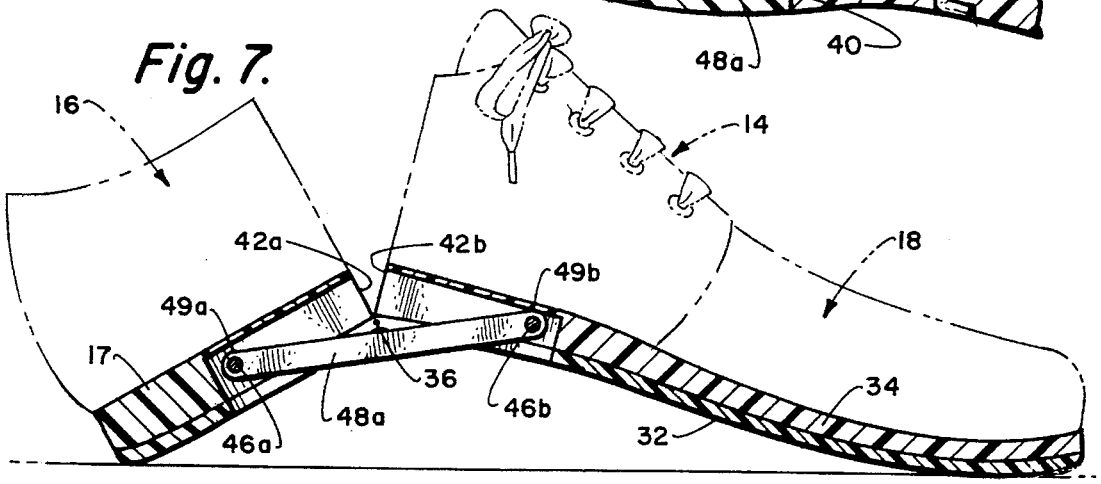

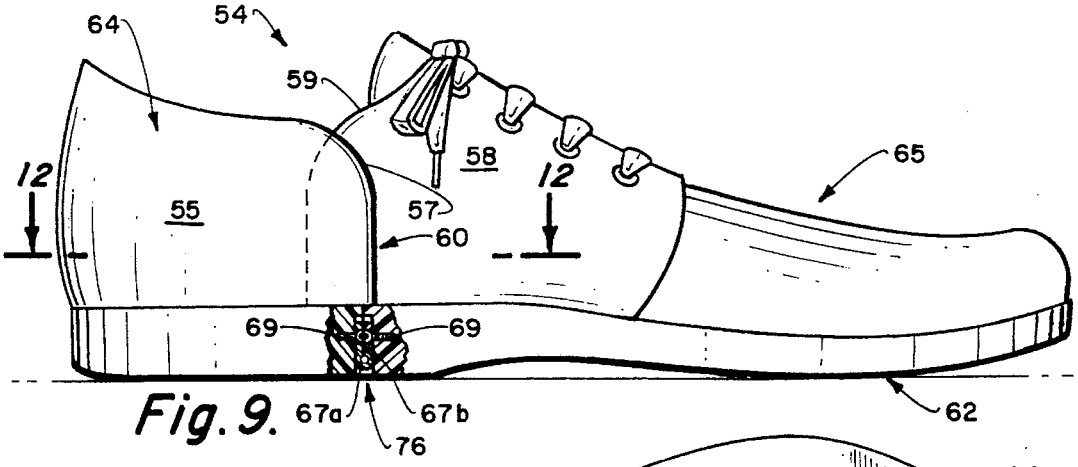
Fig. 9.
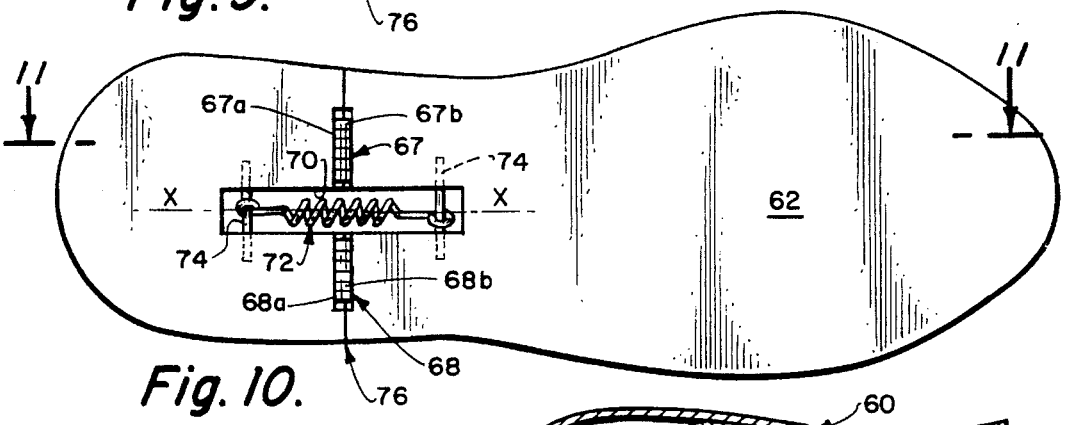
Fig. 10.
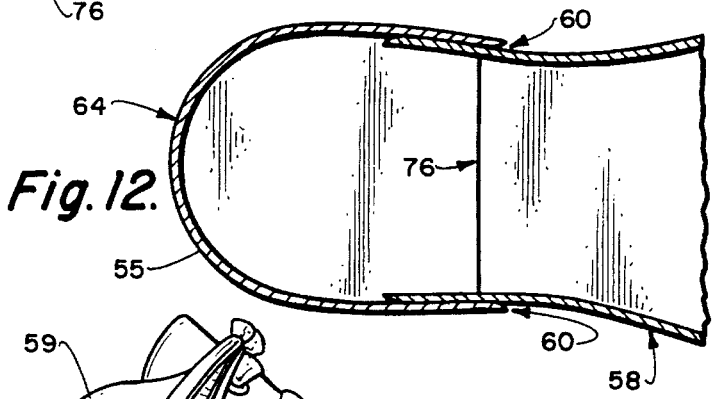
Fig. 12.
Fig. 11.
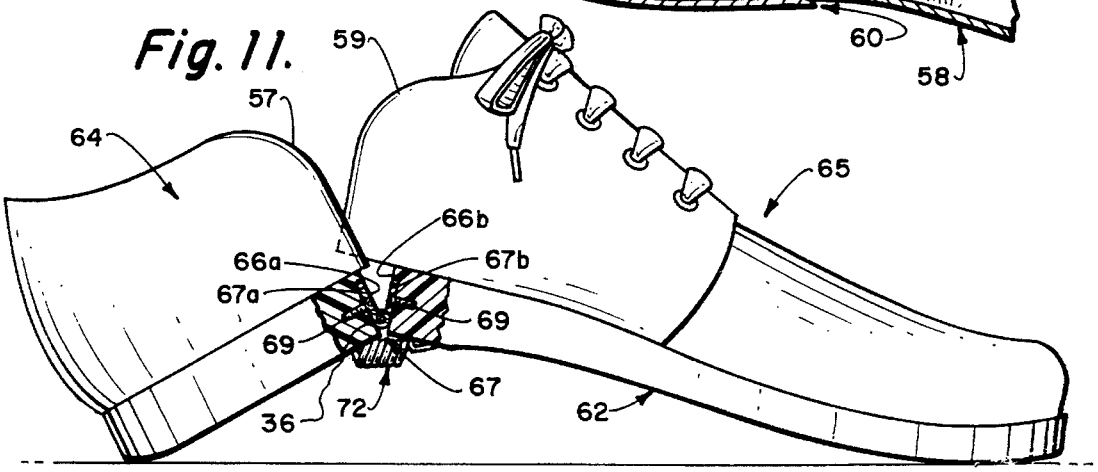

SNAP-ON HINGED SHOE

BACKGROUND OF THE INVENTION

1. Field of the Invention

The present invention relates to footwear and, more particularly, to a shoe construction that is helpful to physically impaired users.

2. Description of Related Art

There are numerous circumstances whereby a person is unable to bend down to put on a pair of shoes. Injury, disease, arthritis, obesity and surgery are a few of the reasons why it is desirable to provide a simple and easy way to put on an article of footwear without the use of one's hands or the necessity of bending down. This problem is not new and numerous appliances have been devised to overcome it.

For example, elongated shoe horns are often used to provide a means for permitting the engagement of one's foot with a shoe. Unfortunately, most shoe openings are too small and require hand manipulation to permit entry. As such, the elongated shoe horn is not helpful to many people who cannot reach down.

To enlarge the shoe opening, a variety of shoes have been developed having a movable heel counter. U.S. Pat. No. 4,969,277 shows a hinged heel counter which is adjustably held together by Velcro straps. U.S. Pat. No. 3,192,651 shows a hinged plate which is secured with a buckle and strap arrangement. In U.S. Pat. No. 5,184,410, the sole of a shoe is hinged to the heel allowing the heel to pivot away from the upper. Because of the loose hinge, the shoe parts must be held together with a locking plunger mechanism.

There are numerous other patents that describe shoes that are elongatable. Examples of these constructions are U.S. Pat. No. 3,997,985 which shows a separable heel and sole arrangement having a series of screw openings that allow the longitudinal adjustment of the heel relative to the sole. A similar arrangement is shown in U.S. Pat. No. 4,178,925 wherein a heel part and sole plate are provided with transversely extending spacers which are held together with a pair of metal rods and associated fasteners. In U.S. Pat. No. 2,252,315, a slipper is disclosed that simply utilizes an elastic band for allowing the slipper to be longitudinally extended.

Unfortunately, none of the above constructions obviate the need to not bend down or use one's hands. In fact, only the shoe construction shown in U.S. Pat. No. 5,282,327 appears to have addressed this problem. In this patent, a sandal is shown having a rigid sole and looped cloth upper. A tilting rear heel assembly is secured to an underlining base which is fastened to the upper part of the sole. An L-shaped heel part is tilted backwards by springs wherein a user inserts their foot into the cloth loop and presses down with their heel to rotate the heel part against the back of the user's foot. As the bottom of the heel part engages the base structure, a latching mechanism secures it in place. When the user wishes to disengage the heel, a rearwardly extending plunger is pressed against a solid object which releases the mechanism.

Merely describing the above assembly makes obvious its significant complexity and cost to produce. Also, it has limited application to primarily a sandal-type of footwear. This is because the sole does not bend and only the "L" shaped heel part rocks backwards. Therefore, only a shoe that has significant open space between the shoe upper and heel can be used.

SUMMARY OF THE INVENTION

The present invention overcomes the above-mentioned disadvantages in that the use of straps, latches, plungers, and their supporting mechanisms are avoided. Further, the invention can be incorporated into a normal shoe design wherein a casual observer would be unable to ascertain the presence of the invention.

One basic aspect of the invention provides for the separation of front and back shoe parts by using the sole itself as a hinge. The invention further contemplates the use of a single holding mechanism that will maintain the front and back parts in an open or a closed position. Such mechanism involves a biasing means using compression or tension forces to move a hinge means above or below the plane of a maximum stress line. Such line is most readily visualized as the longitudinal axis of the biasing means. Maximum stress will occur when the hinge means axis of rotation intersects with the transversely extending stress line. Unless there is some type of structural or mechanical impediment, the hinge means will inherently move past the point of maximum stress to a position of lowest possible stress.

To effect movement of the hinge means, opposing ends of the biasing means are connected to the shoe at respective opposite sides of the hinge means axis. The connection points will also be orthogonally offset from the hinge means axis when the shoe parts are in an open or a closed position.

To hold the shoe parts in a closed position with the hinge means axis below the maximum stress line, the invention most conveniently utilizes an abutment joint formed by opposing faces of the sole itself. This impediment will maintain a reduced, but effective level of stress for holding the sole in a substantially flat disposition for subsequent use.

To hold the shoe parts in an open position for easy access with one's foot, the hinge axis will be above the maximum stress line and the only impediment to reaching zero stress will be the flexural strength of the sole or the frictional resistance of a mechanical hinge.

With the shoe parts in an open position, a user can insert their foot into the upper and then step down. This will move the hinge means below the maximum stress line and cause the shoe parts to come together until the opposing sole faces abut against each other. The shoe parts will be held together by the remaining stress of the biasing means and a user can simply walk away without ever having to bend down or touch the shoe in any way. To remove the shoe, the user need only to step out of the shoe while holding the heel with the other foot.

From the above, it can be seen that the invention utilizes simple structures and forces inherent in the shoe itself, or in readily available common elements. As such, all of the complicated mechanisms, closure latches, sliding plates and fabric connectors found in the prior art are entirely unnecessary.

BRIEF DESCRIPTION OF THE DRAWING

FIG. 1*a* is a side elevational view of a shoe having a sole with an upper shown in phantom including a fragmentary opening in the sole revealing a tension means holding the shoe in a closed position.

FIG. 1*b* is a schematic drawing showing the orthogonal positions of the longitudinal axis of the tension means of FIG. 1*a* relative to the rotational axis of the shoe hinge means.

FIG. 2 is a bottom plan view of FIG. 1*a*.

FIG. 3*a* is a cross-sectional view taken along lines 3—3 of FIG. 2 showing the shoe in an open position.

FIG. 3*b* is a schematic drawing showing the orthogonal positions of the hinge means axis relative to the longitudinal axis of the tension means of FIG. 3*a* when the shoe is in an open position.

FIG. 4 is a fragmentary cross-section view taken along lines 4—4 of FIG. 1*a*.

FIG. 5 is a side elevational view of the shoe of FIG. 1*a* wherein the fragmentary opening in the sole shows a compression means for holding the shoe in a closed position.

FIG. 6 is a bottom plan view of the shoe shown in FIG. 5.

FIG. 7 is a cross-sectional view taken along lines 7—7 of FIG. 6 showing the shoe in an open position.

FIG. 8 is a cross-sectional view taken along lines 8—8 of FIG. 5.

FIG. 9 is a side elevational view of an alternative shoe being held in a closed position with a tension means including a fragmentary opening showing a cross-section of a unitary sole and a mechanical hinge.

FIG. 10 is a bottom plan view of FIG. 9.

FIG. 11 is a side elevational view of the shoe of FIG. 9 in an open position.

FIG. 12 is a fragmentary cross-sectional view taken along lines 12—12 of FIG. 9.

DESCRIPTION OF THE PREFERRED EMBODIMENTS

With particular reference now to FIGS. 1*a* and 4 of the drawings, an overall shoe construction is shown by reference 10. Because the invention has applicability to a wide variety of footwear designs, a generic shoe upper 14 is shown in phantom. The upper comprises a back part 16 and a front part 18. As shown, the back part encompasses the shoe opening portion of the shoe including the area from the heel counter 16*a* to the beginning of vamp 18*a*. The front part encompasses the vamp 18*a* and forefoot cover 18*b*.

The two parts come together at upper joint 19 which may take a variety of forms. Presumably, the edges of each shoe part will have structural integrity and could incorporate a design feature to render the junction of the parts unnoticeable. The upper parts are connected to sole 12 in a conventional manner such as by adhesion, stitching or fastening means.

The overall sole of the invention may be constructed of a thick, resilient material and comprise one unitary body. However, a unique aspect of the invention is that the sole itself may be used as a hinge means. In such case, it is preferred that the sole be constructed of at least an outsole, shown by reference 32, and a midsole, shown by reference 34. Typically, such sole parts are laminated together and include a heel section 17. When constructed in this manner, the hinge means will create a crease line 38 extending across the outsole at a location forward of the heel 17 and backward from the vamp 18*a*. The midsole will be severed into two sections and form an extension of upper joint 19. Each section will then have an abutment face 42*a* and 42*b* which combine to form abutment joint 40. As so located, and with the outsole being constructed of a typically wear-resistant material which is inherently flexible, the outsole crease line will form the hinge 37 of the shoe.

It will be appreciated that the above arrangement is preferred where the midsole typically comprises a thick cushioning material and the outsole comprises a thin dense layer of wear resistant material. However, when the sole comprises a single layer of flexible material, the hinge axis will likely be proximate the middle of the sole thickness. If the flexural strength of the sole material is relatively high, the abutment joint 40 may then be unnecessary. If it is necessary, upper joint 19 can function as the abutment, i.e., means for preventing the biasing means from drawing the sole beyond about a 180 degree orientation. Alternatively, if the sole is exceptionally thick, it can be partially severed to create the desired hinge and abutment joint characteristics. In all cases, the biasing means should possess sufficient strength to significantly overcome the flexural resistance of the sole.

With further reference to FIGS. 1*a*–4, the biasing means comprises a tension means operating in conjunction with anchor means to produce the desired shoe part positioning forces. As shown, the tension means comprises a tension spring 20 with opposing connector ends 22*a* and 22*b*. Preferably, the connector ends extend axially from the spring coils and comprise curled end structures for pivoting engagement with respective anchor bolts 24*a* and 24*b*. The center axis of the bolts is referenced by numeral 26.

Although the tension spring could be engaged to exterior anchor means and operate adequately along the outside edges of the sole, it is preferred that the spring be hidden from view. For this purpose, an elongated recess 28 is formed in the bottom of the sole. As best seen in FIGS. 2, 3*a* and 4, the recess extends across abutment joint 40 with a longitudinal extent and width somewhat larger than the width and longitudinal extent of the corresponding tension spring.

To secure the spring within the recess, it is most expedient to provide cross-bores across the sole and recess opening. Head bolts 24*a,b* are inserted through the bores and through the curled end structures of the spring connector ends. Respective nuts 25*a,b* are used to hold the bolts in place. Note that pins, shafts, screws, nails or other equivalent anchor means known in the art could also be used in place of the bolts. Also, the anchor means may be embedded in the sole material during the molding process rather than extending through the aforementioned bore openings.

To permit the spring to function as a releasable holding means for the shoe parts, it must be anchored so that its longitudinal axis is offset above the hinge axis 36 when the shoe sole is substantially flat as shown in FIG. 1*a*. The perpendicular distance between the longitudinal axis x,x and the hinge axis 36 creates a leverage span 30. The spring tension operating in conjunction with the leverage span creates an effective closure force for holding the shoe parts together in a closed position.

As the shoe parts are being opened, the hinge axis will move upwardly from its position shown in FIG. 1*b* and cross the longitudinal axis x,x of the tension spring. At this point, the spring will be stretched to the maximum length and tension. Once it passes this point, the shoe parts will continue being pulled-apart until the spring tension has subsided to a zero or nominal amount. At this point, the hinge axis will be above the longitudinal axis of the spring as depicted in FIG. 3*b*.

To achieve the reduced tension position, it is important that the spring length between the bolt axes 26, when there is zero or nominal spring tension, be less than the corresponding length of shoe sole between the opposing bolt axes. The length differential is illustrated in FIG. 3*b* and will function to hold the shoe in an open position until an external force, such as the weight of one's foot, overcomes the spring tension and allows the shoe sole to be flattened.

It will be appreciated that to enhance the appropriate alignment and engagement of the shoe parts when closed, it is preferred that faces 42*a,b* of abutment joint 40 extend perpendicular to the longitudinal axis of the sole. It is also helpful to align the faces parallel to the hinge axis 36.

With reference now to FIGS. 5–8, a variation of the aforementioned biasing means is shown. Reference numerals denoting the same structures as described above will be carried forward in the following description. In this embodiment, the anchoring means and biasing means are located relative to the hinge means in the same manner and relative positions as in FIGS. 1*a*–4. However, the biasing means will comprise a rigid compression means and the anchoring means must be located in a resilient material. Thus, when the compression means interconnects each of the opposing anchor means, the anchor means will be drawn against the sole material during closure of the shoe. This will cause a counteracting force emanating from the material's resilience. Such counteracting force thereby functions to create the open and closed holding positions of the shoe parts.

As best shown in FIGS. 6–8, the anchor means comprise identical bars 46*a,b* which extend across the sole and pass through corresponding recesses 50. The bars are preferably aligned parallel to abutment joint 40 and are embedded in the sole material above the hinge axis 36. The bars are provided with bent ends to help insure their secure placement in the cushioned sole material.

Interconnecting the anchor bars are two spaced-apart rigid elements 48*a,b*. As shown, the rigid elements are flat strips of metal, plastic or wood with opposing strip ends 49*a,b*. Each end includes an aperture through which the anchor bars extend. The elements extend parallel to each other and perpendicular to abutment joint 40. They have less width than the corresponding depth of recesses 50 so that concealment will occur when the sole is flat.

In the same manner as with the tension springs, the axial length of the rigid elements between the anchor bars is less than the corresponding length of sole that extends beneath the anchor bars. This difference in length will create a sufficient counteracting compression force to hold the shoe parts in an open configuration as shown in FIG. 7.

Although two spaced-apart rigid elements are shown, at least one or three could be used to effect the derived force. Other important considerations would be the aforementioned length differential and elastic characteristics of the sole material.

When a user inserts their foot into the open shoe and steps down, the sole will become flattened and the hinge axis will move from above the longitudinal axis of the rigid element to a point below it. This action will pull the anchor bars inwardly relative to the sole and compress the resilient material in front of the bars. The compression wrinkles are shown by reference 52 in FIG. 5. The counteracting resilient force, acting in conjunction with the leverage span 30, will serve to maintain abutment joint 40 in an abutting relationship in the same manner as with the previously described tension spring.

Although the invention has been described with the outsole comprising the hinge, it will be understood that the hinge means can include a conventional mechanical hinge structure known in the prior art. With reference to FIGS. 9–12, an overall shoe construction 54 is shown which is substantially similar to shoe 10 in FIGS. 1–8. However, this embodiment is intended to show an overlapping upper joint, a unitary sole and a mechanical hinge. The biasing means structure, location and operation will not be changed. For purposes of illustration only, the biasing means is depicted as tension spring 72.

As best seen in FIGS. 9, 11 and 12, the upper joint of heel counter 55 has been altered by curving its forward edge 57. Also, the edge has been beveled and slightly flared outwardly. In a similar fashion, rear edge 59 of vamp 58 has been extended and curved along its upper portion. The edge has also been beveled and moved inwardly slightly to form an overlapping upper joint 60. This arrangement provides a larger opening for initial insertion of a disabled person's foot. It also provides a stronger joint.

A unitary sole 62 has been shown which has been severed at a location proximate the beginning of vamp 58. This divides the shoe into a separate back part 64 and front part 65 with respective abutment faces 66*a* and 66*b*. To form an abutment joint 76, each face is provided with respective indented areas for securement of flanges 67*a,b* and 68*a,b* of mechanical double leaf hinges 67 and 68, respectively. The flanges are secured to the sole on opposing sides of recess 70 by screw fasteners 69. Both hinges share a common hinge axis 36 which is located proximate the shoe bottom. This location permits the desired abutment action for disposing the sole in a flat position.

Tension spring 72 is connected at its opposing ends with pegs 74. The pegs are a variation of the anchor means shown in FIGS. 1–8 and can be embedded in the sole during the molding process. They have the advantage of not being visible from outside the shoe.

As mentioned, the mechanical hinges will interrelate with the tension spring or a rigid element, whichever the case may be, in the same manner as described hereinabove. Additionally, the mechanical hinges are entirely suitable for use with multi-layered sole structures. It can also be seen that each flange of the hinges conveniently form a part of the abutment joint 76. This feature will help to strengthen the joint and resist distortions during use.

While the invention has been described with respect to preferred embodiments, it will be apparent to those skilled in the art that various modifications and improvements may be made without departing from the scope and spirit of the invention. Accordingly, it is to be understood that the invention is not to be limited by the aforementioned specific illustrative embodiments, but only by the scope of the appended claims.

I claim:

1. An article of footwear comprising separable front and back parts which are interconnected by a resilient sole at a crease line extending across said sole, a rigid element extending across said crease line having an axial extent defined by the distance between opposing first and second ends of said element, said first end being attached to said sole adjacent said front part at a first location, said second end being attached to said sole adjacent said back part at a second location, the length of said sole extending between said first and second locations being greater than the axial extent of said rigid element.

2. The article of claim 1 wherein said sole comprises an outsole overlying a resilient midsole, said first and second locations being at said midsole.

3. The article of claim 2 wherein said crease line extends across said outsole and said midsole is divided into two sections each of which become a corresponding portion of said front and back parts.

4. The article of claim 3 wherein said two sections have respective end faces that abut against each other when said outsole is in a flat orientation.

5. The article of claim 1 wherein said sole includes an elongated recess for enclosing said rigid element when said sole is in a flat orientation.

6. In a shoe having an upper divided into front and back parts, said parts being connected by a hinge means wherein the improvement comprises:

a biasing means extending across said hinge means having a first end attached to said back part and a second end attached to said front part, said biasing means being below said hinge means when said front and back parts are apart so as to maintain the front and back parts apart and above said hinge means when said front and back parts are together so as to urge front and back parts together.

7. The shoe of claim 6 including a flexible outsole attached to said front and back parts, said hinge means comprising a crease in said outsole extending along a line that divides said front and back parts.

8. The shoe of claim 6 wherein said front and back parts include a midsole extending between said outsole and said parts, said first and second ends of said biasing means being pivotally secured to respective portions of said midsole.

9. The shoe of claim 8 wherein said midsole includes an elongated recess for enclosing said biasing means when said biasing means is above said hinge means.

10. The shoe of claim 8 wherein said midsole is constructed of resilient material having first and second anchor means embedded in said material at predetermined locations, said biasing means comprising a rigid element with said first end connected to the first anchor means and said second end connected to the second anchor means.

11. The shoe of claim 6 wherein said biasing spring comprises a tensioning means.

12. In a hinged shoe having front and back upper parts that can be opened and closed by a user's feet comprising:

a flexible sole;

a hinge means extending across said sole creating front and back sole sections to which respective front and back upper parts are secured;

an anchor means secured to each of said back section and said front section wherein the distance between said anchor means defines a predetermined length of said sole and, a biasing means having opposing ends each one of which is connected to a respective anchor means defining an axial length that is less than said predetermined length of said sole whereby said biasing means will maintain said hinge means above said biasing means unless a user steps into said shoe and flattens said sole causing said hinge means to move below said biasing means.

13. The shoe of claim 12 wherein said sole comprises a midsole covered by a flexible outsole, said hinge means comprising a crease line extending across said outsole, said sole including an abutment joint comprising opposing end faces of said midsole extending upwardly from said crease line.

14. The shoe of claim 13 wherein said end faces abut against each other when said sole is in a substantially flat orientation.

15. The shoe of claim 12 including a recess extending into said sole for enclosing said biasing means when said sole is in a flat orientation.

16. The shoe of claim 12 wherein said biasing means comprises a tension spring and creates tension between the anchor means of said front and back sections when above said hinge means.

17. The shoe of claim 12 wherein said sole is constructed of a resilient material within which said anchor means are secured and said biasing means comprises a rigid element.

18. An article of footwear comprising a rear part and a front part connected by a hinge means at an abutment joint to permit said parts to be rotated away from each other; and, a biasing means interconnecting said parts having a longitudinal axis that is below the hinge means when the parts have been rotated away from each other so as to maintain the front and back parts apart and above the hinge means when the parts are together so as to urge the front and back parts together.

* * * * *